United States Patent [19]

Meyer et al.

[11] 4,364,898

[45] Dec. 21, 1982

[54] METHOD FOR THE PREPARATION OF RADON-211

[75] Inventors: Geerd-J. Meyer, Hannover-Burgdorf, Fed. Rep. of Germany; Richard M. Lambrecht, Quogue, N.Y.

[73] Assignee: The United States of America as represented by the United States Department of Energy, Washington, D.C.

[21] Appl. No.: 195,967

[22] Filed: Oct. 10, 1980

[51] Int. Cl.[3] ..... G21G 1/10

[52] U.S. Cl. ..... 376/190; 376/202

[58] Field of Search ..... 376/190, 187, 202

[56] References Cited

PUBLICATIONS

IPNO-RC-77-10, "Excitation Functions for Quasi--Elastic Transfer Reactions Induced with Heavy Ions in Bismuth", Gardes et al., pp. 1–42, 9/27/78.

International Journal of Applied Radiation and Isotopes, 6/80, pp. 351–355.

BNL-27469, 6/80.

Physical Review C, vol. 12, No. 1, 7/75, pp. 42–49, Friesleben et al.

*Primary Examiner*—Harvey E. Behrend

[57] ABSTRACT

A method for the production of $^{211}Rn$ comprising bombarding $^{209}Bi$ with $^{7}Li$ particles utilizing the nuclear reaction $$^{209}Bi(^{7}Li,5n)^{211}Rn.$$

The method provides a simple spectrum from which $^{211}Rn$ can be easily isolated in a highly pure condition.

5 Claims, 2 Drawing Figures

METHOD FOR THE PREPARATION OF RADON-211

BACKGROUND OF THE INVENTION

The invention described herein was made or conceived in the course of, or under a contract with, the U.S. Department of Energy.

FIELD OF THE INVENTION

This invention relates to the field of preparation of high purity $^{211}$Rn radioisotope.

DESCRIPTION OF THE PRIOR ART

The radioactive isotopes of noble gases are considered important for a variety of reasons, generally depending on the characteristics of the radioactive decay of the isotope. For example, the long lived $\beta$- and $\alpha$-emitters, such as, $^{133}$Xe and $^{222}$Rn, have been found in the emission of both nuclear and coal-fired power plants at relatively high levels of more than 1 Ci/year·1000 MW. Thus, these isotopes have the potential of being serious pollutants.

The relatively short lived $\gamma$-emitting isotopes, e.g., $^{123}$Xe, $^{81m}$Kr, and $^{77}$Kr, have been used in nuclear medicine. Moreover, the noble gas species which decay by electron capture are of great interest in hot atom chemistry since they provide energetically excited halogens which can ultimately be used for excitation labeling.

Formerly, the Rn isotopes were only limitedly available in mCi quantities. Thus, the $\alpha$-emitter $^{222}$Rn (t $\frac{1}{2}$=3.8 d) can be isolated as decay product from $^{226}$Ra. However, $^{211}$Rn (t $\frac{1}{2}$=14.2 h) which decays mainly via EC 74%, has, in the past, been produced only by spallation reactions on relatively heavy targets, such as, Th or U using 600 MeV protons or heavy ions having equal energies, such as, Ar or Kr. $^{211}$Rn is easier to detect than $^{222}$Rn because of its decay properties and thus represents a better isotope for chemical studies and the determination of absorption properties. Moreover, the 74% EC decay branch leads to $^{211}$At which is of great interest in biomedical applications as well as hot atom excitation labeling studies. Thus, $^{211}$Rn provides a generator system for $^{211}$At.

$^{7}$Li induced reactions on $^{209}$Bi up to 34 MeV have been investigated (see Huizenga et al, University of Rochester Report No. COO-3496-44 (1974), p. 97). It has been found that at this energy, cross sections of 180 mb and 80 mb have been found for the ($^{7}$Li,3n) and ($^{7}$Li,4n) reactions, respectively. Comparable data in this energy range has been reported on gold targets (C. E. Anderson, et al., Nucl.Phys. 45, 41 (1963)). Cross sectional measurements with Li ions of higher energy are relatively rare. However, the $^{141}$Pr($^{6}$Li,5n)$^{142}$Sm and $^{141}$Pr($^{7}$Li,6n)$^{142}$Sm reactions up to 72 MeV have also been investigated (see M. Kaplan, Phys. Rev. 143, 894 (1966)).

SUMMARY OF THE INVENTION

We have discovered a relatively simple method for the production of $^{211}$Rn so that it can be easily isolated from the target and obtained in high yields. More particularly, we have discovered that the radioisotope $^{211}$Rn can be prepared by the bombardment of $^{209}$Bi with $^{7}$Li particles using the nuclear reaction $^{209}$Bi($^{7}$Li,5n)$^{211}$Rn. The $^{211}$Rn can be isolated from the target quite easily by degassing at elevated temperatures and the radiochemical purity of the product is better than 98%. It can thus be used as a generator system for $^{211}$At which is of potential interest in biomedical applications. The excitation function for this reaction is about from 40 to 60 MeV and the cross section for $^{211}$Rn production reaches 650 mb at 53 MeV producing a saturation yield of 5.5 $\mu$Ci/nA.

DESCRIPTION OF THE PREFERRED EMBODIMENT

Figure 1:
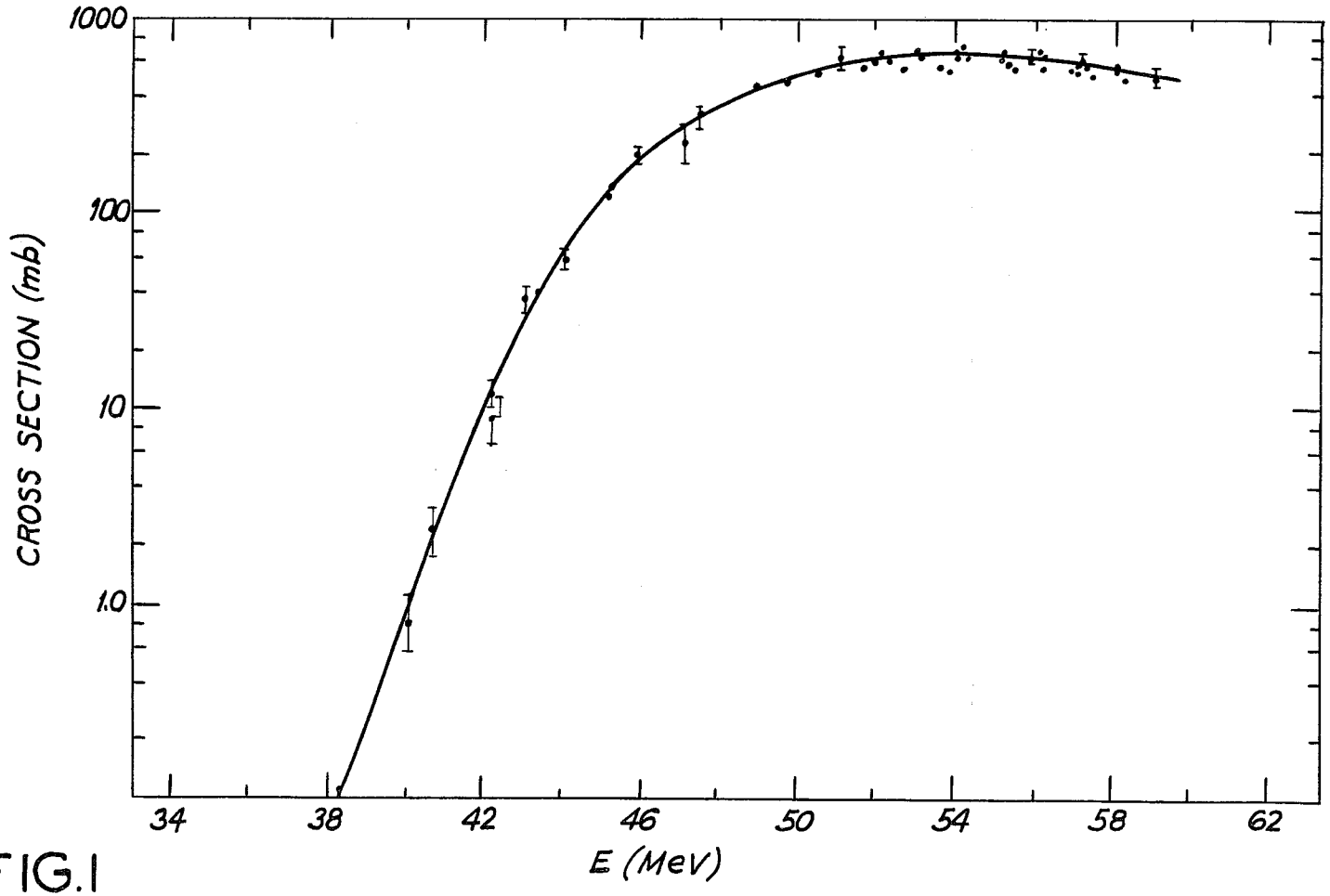
FIG. 1 is a graphical cross section for the $^{209}$Bi($^{7}$Li,5n)$^{211}$Rn reaction as a function of $^{7}$Li energy.

The cross sections for the reactions of the present invention are similar in magnitude to those discussed hereinabove, namely, 570 mb at 62.5 MeV for the ($^{6}$Li,5n) and 428 mb at 71.5 MeV for the ($^{7}$Li,6n) reactions, respectively (M. Kaplan, Phys. Rev. 143, 894 (1966)). The absolute cross section for the $^{209}$Bi($^{7}$Li,5n)$^{211}$Rn reaction indicates that the compound nucleus formation with successive neutron evaporation is the major reaction channel for Li induced reactions on Bi between 30 and 60 MeV. This follows the findings of Huizenga et al (University of Rochester Report No. COO-3496-44 (1974), p. 77) that the fission to neutron evaporation ratio in the compound nucleus $^{216}$Rn is smaller than $10^{-2}$ up to 30 MeV and there is no indication of a significant increase at higher energies.

The $^{6}$Li and $^{7}$Li induced reactions on $^{232}$Th and $^{238}$U reveal much higher fission cross sections, i.e., up to 100 mb at 34 MeV. Preliminary data for the neutron evaporation on $^{238}$U targets indicate relatively low cross sections. The fission to neutron evaporation ratio is reversed with heavier targets. Additionally, other reaction channels, such as, stripping or pick-up reactions and nuclear transformations induced by the break up of the Li projectile in the coulomb field of the target nucleus, also contribute to the overall cross section of Li induced reactions. It appears, however, from the small amount of comparable data available, that their contribution is certainly no larger than that from the compound nucleus formation.

It is also noted that in contrast to the spallation reactions on U and Th which have been used to produce $^{211}$Rn, bombardment of Bi with $^{7}$Li ions produces a relatively limited product spectrum. This allows the effective separation of $^{211}$Rn utilizing simple degassing of the target at elevated temperatures, i.e., 400° C.

At, Po, Bi and Pb isotopes could easily be trapped on Ag-wool and Te-filters. Since the cross section for $^{210}$Rn (t $\frac{1}{2}$=2.5 h) production using the ($^{7}$Li,6n) process is nearly an order of magnitude smaller than that for the $^{211}$Rn (t $\frac{1}{2}$=14.6 h) production, the amount of $^{210}$Rn at 8 hours after EOB was less than 1%.

The cooling time results in a 32% loss of the original $^{211}$Rn activity due to decay. In the production of pure $^{211}$At, the radionuclidic impurities are negligible because of the 96% $\alpha$-decay of $^{211}$Rn to $^{208}$Po. For $^{211}$At production, if the $^{210}$Rn does not interfere, a short cooling time of about 1 hour is generally sufficient to yield 99% purity $^{211}$At. The other competing reactions with the target material, e.g., ($^{7}$Li,xn), ($^{7}$Li,pxn), and ($^{7}$Li,$\alpha$xn) wherein x is 1 to 4, lead to either very short lived Rn or At, Po, Bi, or Pb isotopes which decay by pure $\alpha$-emission or are very long lived. When used as a generator for $^{211}At$, $^{211}Rn$ produces a maximum activity after 14 hours. About 50% of the maximum $^{211}At$ activity is still available, however, after about 40 hours.

The following experiments illustrate the present invention:

$^{7}Li$ ions were accelerated in a three stage Tandem Van de Graaff system. Incident beam energies ranging between 49 and 61 MeV were determined with an analyzing magnet. The arrangement of an electrically isolated beam collimator (5 mm o.d.) beam stop and Faraday cup for beam current integration are as described in R. Colle, et al. Phys. Rev. C9, 1819 (1974).

The targets consisted of up to 12 stacked Al foils (3.428 or 1.714 mg/cm$^2$) onto which Bi had been evaporated to a thickness of 2.0±0.1 mg/cm$^2$. In certain stacks, the Bi layer on each foil was sealed by a 1.714 mg/cm$^2$ Al cover foil in order to prevent eventual evaporation and recoil losses of product nuclei. In any event, the recoil and other losses of $^{211}Rn$ in the thin targets were negligible. The energy absorption of the target stacks ranged from about 6 to 30 MeV and was calculated using the weight of each foil and the range and stopping power tables set forth in L. C. Northcliff and R. R. Shilling, Nuclear Data Tables, A7, 233 (1970).

Nine target stacks were irradiated for 1 to 2 hours each at constant beam intensities (±10%) ranging between 30 and 100 nA in separate experiments. Additionally, two thick Bi targets of 56.3 mg/cm$^3$ and 120 mg/cm$^2$ were bombarded for 2.5 and 5 hours, respectively, using a 60–80 nA beam. The irradiated targets were cooled for about 8 to 10 hours to allow the short lived impurities to decay. Individual samples were then assayed with a Ge(Li) detector calibrated with NBS-mixed standards. Certain of the targets were heated in a quartz oven at 500° C. under a stream of He, passed through a filter of silver wool and tellurium to remove all radionuclidic impurities of Po.

The $^{211}Rn$ was quantitatively trapped with liquid nitrogen cooled charcoal traps and counted in a standard geometry as were the targets themselves.

The γ-spectra were recorded on magnetic tapes and analyzed with the program INTRAL on the CDC-7600 computer (R. Gunnick, H. B. Levy and J. B. Niday, University of California Radiation Laboratory Report No. UCID-15140 (unpublished), as modified by B. Erdal and J. B. Cumming). It is estimated that the overall error in the absolute cross section measurements is less than 12%.

The quantitative analysis of the γ-spectra showed that the $^{211}Rn$, its direct decay products, i.e., $^{211}At$ and $^{207}Po$ as well as the daughter nuclides of these isotopes, i.e., $^{211}Po$ and $^{207}Bi$ were the main products at 8 hours after the end of the bombardment (EOB). The cross section data for the $^{209}Bi(^{7}Li,5n)^{211}Rn$ reaction are set forth in the following table.

CROSS SECTION DATA FOR THE $^{209}Bi(^{7}Li,5n)^{211}Rn$ NUCLEAR REACTION

The energies were determined to ± 1%. The error indicated on the cross section is the statistical error, resulting from the measurement of at least 10 γ-lines of $^{211}Rn$ for each data point.

| Energy, MeV | Cross Section, mb | Energy, MeV | Cross Section, mb |
|---|---|---|---|
| 58.9 | 489 ± 60 | 52.5 | 504 ± 48 |
| 58.1 | 470 ± 40 | 52.1 | 580 ± 59 |
| 57.9 | 512 ± 57 | 51.9 | 633 ± 90 |
| 57.9 | 526 ± 68 | 51.8 | 574 ± 74 |
| 57.3 | 491 ± 66 | 51.5 | 518 ± 53 |
| 57.1 | 538 ± 56 | 50.8 | 608 ± 78 |
| 57.0 | 599 ± 67 | 50.4 | 488 ± 42 |
| 56.9 | 507 ± 88 | 49.5 | 438 ± 65 |
| 56.9 | 574 ± 80 | 48.8 | 431 ± 45 |
| 56.7 | 519 ± 55 | 47.4 | 301 ± 38 |
| 56.0 | 602 ± 82 | 47.0 | 220 ± 50 |
| 56.0 | 535 ± 108 | 45.8 | 190 ± 18 |
| 55.9 | 652 ± 86 | 45.2 | 136 ± 26 |
| 55.7 | 586 ± 68 | 45.1 | 120 ± 16 |
| 55.4 | 533 ± 53 | 44.0 | 55.9 ± 5.3 |
| 55.2 | 559 ± 44 | 43.3 | 38.2 ± 4.8 |
| 55.0 | 656 ± 115 | 43.0 | 36.2 ± 4.7 |
| 55.0 | 579 ± 141 | 42.2 | 11.6 ± 2.1 |
| 54.9 | 612 ± 95 | 42.2 | 8.6 ± 3.2 |
| 54.1 | 608 ± 77 | 40.7 | 2.4 ± 0.7 |
| 54.0 | 683 ± 96 | 40.1 | 0.8 ± 0.3 |
| 53.9 | 597 ± 93 | 38.3 | 0.10 ± 0.08 |
| 53.9 | 629 ± 91 | | |
| 53.7 | 502 ± 59 | | |
| 53.5 | 535 ± 87 | | |
| 52.9 | 655 ± 82 | | |
| 52.9 | 605 ± 69 | | |
| 52.8 | 665 ± 73 | | |

The threshold energy was 36.2 MeV. The experiments yielded detectable amounts of $^{211}Rn$ above 38 MeV. FIG. 1 shows that the cross section rises from 38 MeV to 50 MeV where it reaches a broad maximum of 500 to 600 mb.

Figure 2:
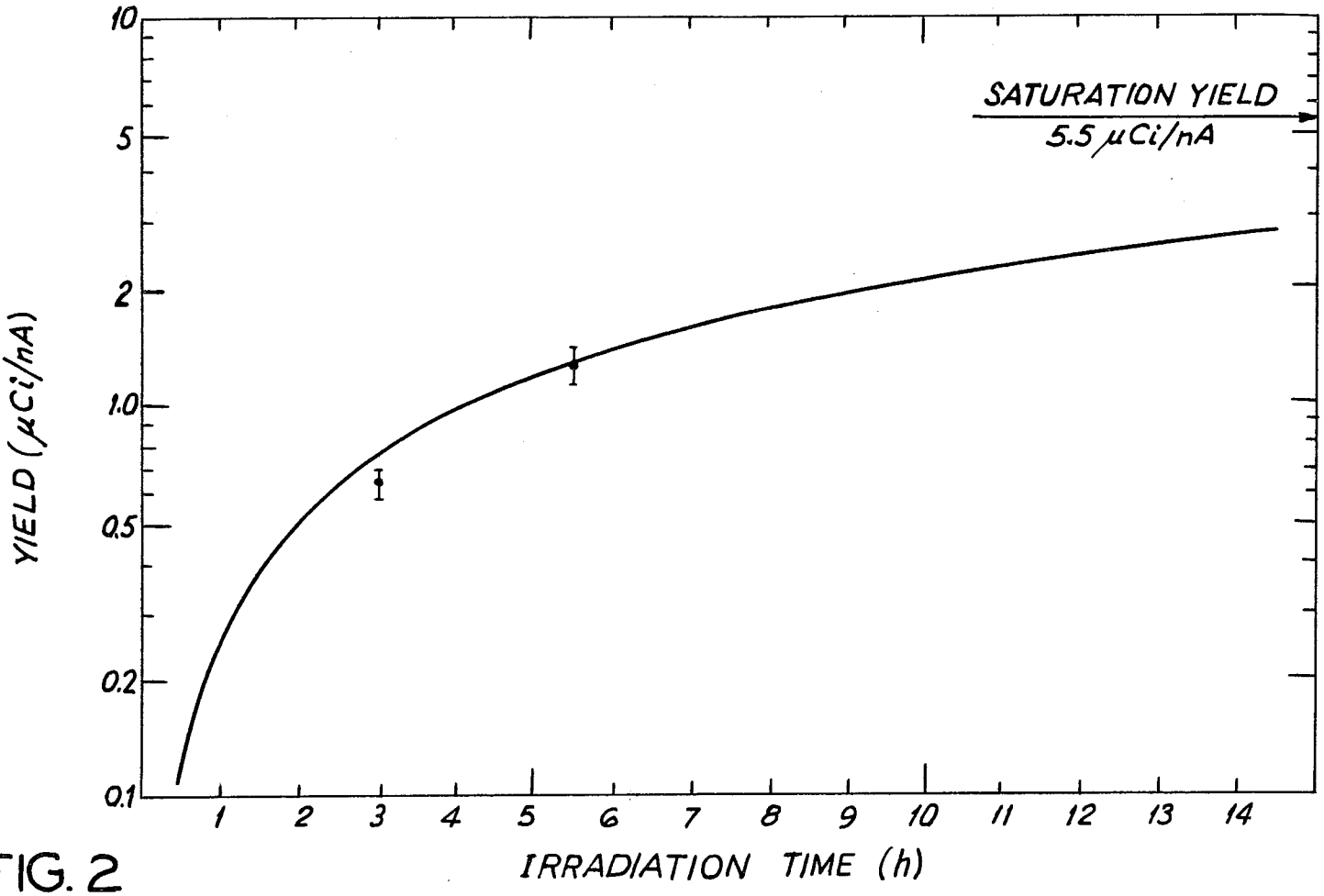
FIG. 2 is a graph of the thick target yield as a function of irradiation time.

FIG. 2 shows a comparison of the production yield in a thick target as calculated from the cross-sectional data with experimental yields of two thick targets. The lower value from the 3 hours irradiation was most likely due to evaporation since this production target was not sealed off with thin aluminum foil. The 5.5 hour irradiation confirmed the calculated values.

Additional γ-lines in the non-processed target spectra arise from $^{210}At$, $^{206}Po$, and $^{206}Bi$. All radionuclidic products can be accounted for by taking the nuclear reactions $^{209}Bi(^{7}Li,6n)^{210}Rn$ and $^{209}Bi(^{7}Li,p5n)^{210}At$ into consideration. The following reaction scheme explains the origin of all detectable γ-emitting product nuclei.

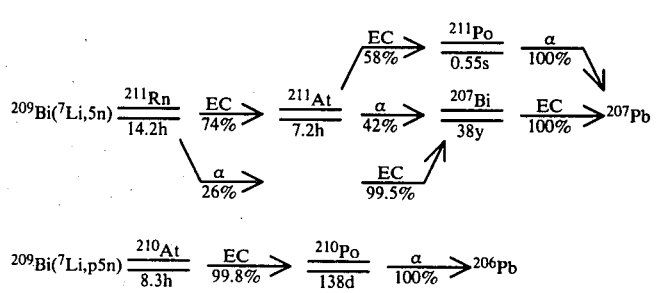

-continued

III.

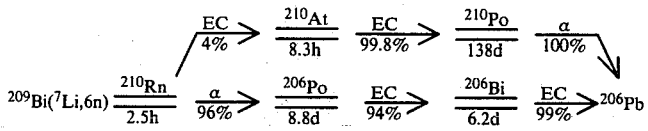

The amount of $^{210}At$ in the targets indicates that the combined cross section for reactions II and III is nearly one order of magnitude smaller than that for the ($^{7}Li$,5n) nuclear reaction of the present invention. The cross section for reactions with losses of more nucleons, e.g., $^{209}Bi(^{7}Li,7n)^{209}Rn$ or $^{209}Bi(^{7}Li,p6n)^{209}At$ are negligible at energies below 60 MeV since $^{209}At$ was not detected in any of the samples.

The product nuclei and daughter activities from the reactions $^{209}Bi(^{7}Li,xn)^{216-xn}Rn$ (X=1–4) would not be expected to be detectable in the target at 8 hours after EOB.

We claim:

1. A method for the production of $^{211}Rn$ comprising bombarding $^{209}Bi$ with $^{7}Li$ particles according to the nuclear reaction $$^{209}Bi(^{7}Li,5n)^{211}Rn.$$

2. The method of claim 1 wherein the $^{211}Rn$ is isolated from the target by degassing.

3. The method of claim 1 or 2 wherein the $^{211}Rn$ is isolated from the target by degassing at elevated temperatures.

4. The method of claim 1 or 2 wherein the $^{211}Rn$ is isolated from the target by degassing at a temperature of about 500° C.

5. The method of claim 1 or 2 wherein the reaction is carried out by accelerating $^{7}Li$ ions in a Van de Graaff system and irradiating targets of aluminum coated with bismuth with the accelerated ions for a period from about 1 to 2 hours, cooling the targets for about 8 to 10 hours, and then heating the targets at about 500° C. under a stream of helium, passing said helium through a filter to remove radionuclidic impurities and trapping the $^{211}Rn$ produced in a low temperature trap.

* * * * *